United States Patent [19]

Weiler

[11] 4,017,648

[45] Apr. 12, 1977

[54] TONER AGITATION THROUGH MICROFIELD DONOR

[75] Inventor: Ernest A. H. Weiler, Rochester, N.Y.

[73] Assignee: Xerox Corporation, Stamford, Conn.

[22] Filed: May 24, 1976

[21] Appl. No.: 689,281

Related U.S. Application Data

[62] Division of Ser. No. 546,589, Feb. 3, 1975.

[52] U.S. Cl. ..... 427/14

[51] Int. Cl.[2] ..... B05D 1/06

[58] Field of Search ..... 427/14, 18, 21, 24, 427/25; 118/637; 355/3 DD; 101/DIG. 13; 346/74 ES

[56] References Cited

UNITED STATES PATENTS

| | | | |
|---|---|---|---|
| 3,037,478 | 6/1962 | Lace | 118/637 |
| 3,203,394 | 8/1965 | Hope et al. | 118/637 |
| 3,216,844 | 11/1965 | King | 118/637 X |
| 3,257,224 | 6/1966 | Jons et al. | 427/18 |
| 3,288,602 | 11/1966 | Snelling | 355/3 R X |
| 3,696,783 | 10/1972 | Fantuzzo | 118/637 |
| 3,759,222 | 9/1973 | Maksymiak | 427/24 X |

*Primary Examiner*—Morris Kaplan

*Attorney, Agent, or Firm*—James J. Ralabate; William A. Henry, II

[57] ABSTRACT

Microfield donors used in a xerographic process and the methods for manufacturing them. The donor is provided with means for establishing a plurality of electrostatic microfields on the donor surface to attract and hold toner particles so they can be transported to a developing station. The polarity of the established microfields are continuously reversed to alternately repel and attract toner particles to the donor surface during their transportation in order to agitate the toner particles to prevent agglomeration of the particles from forming and to effect nullification of the microfield attracting the particles adjacent a photoconductor to form a high density image free of background deposits in uncharged area of the photoconductive surface.

4 Claims, 22 Drawing Figures

FIG. 1
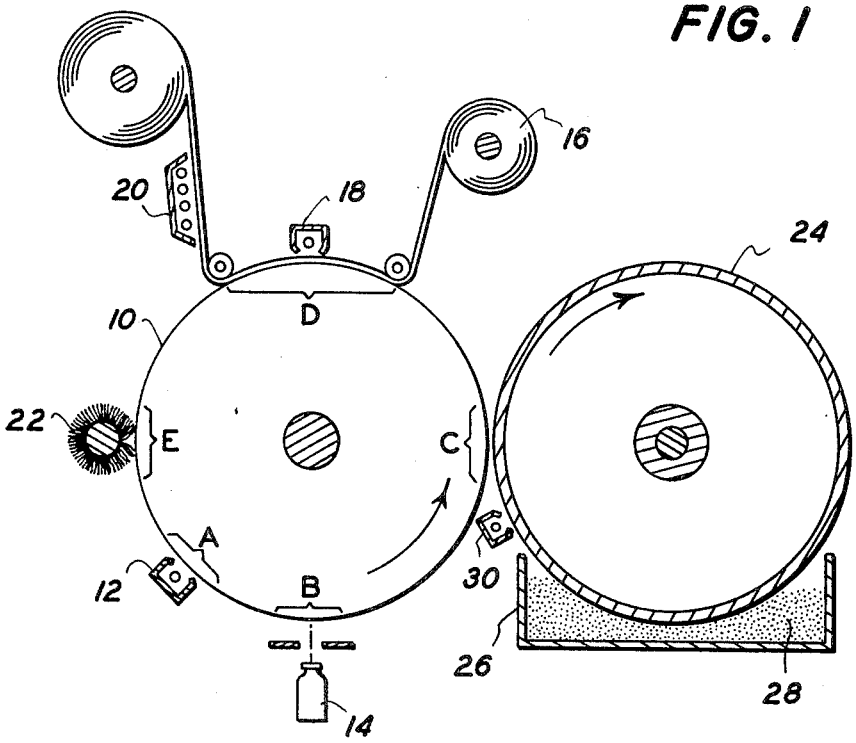
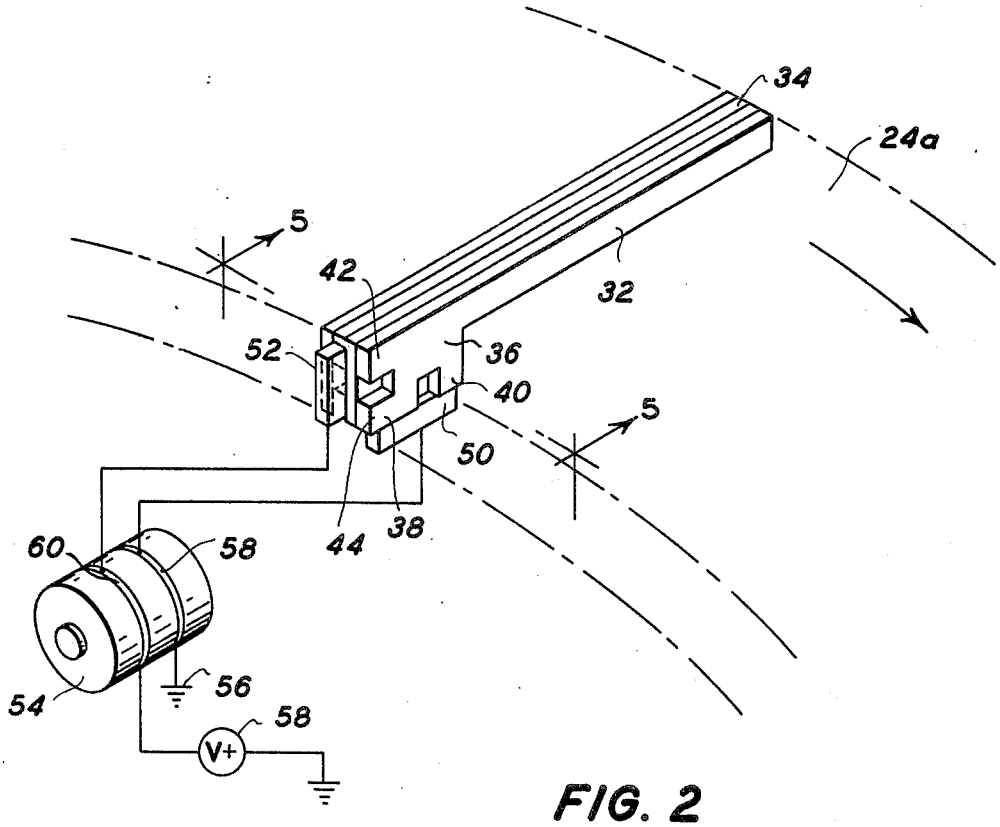
FIG. 2

FIG. 3
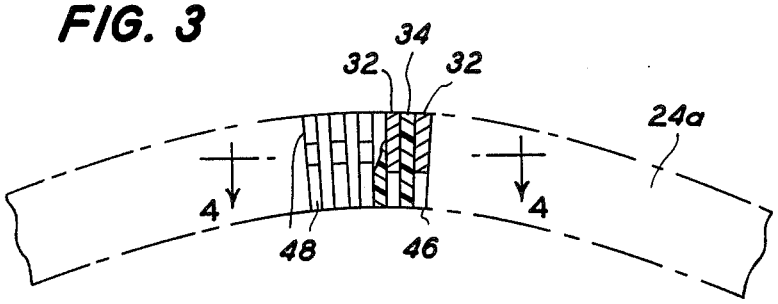
FIG. 4
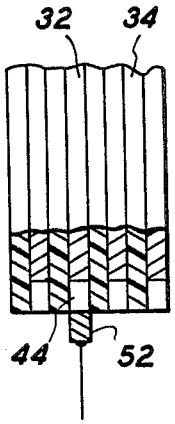
FIG. 5
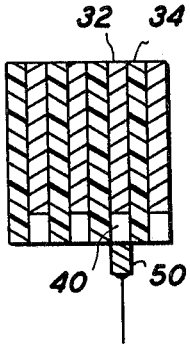
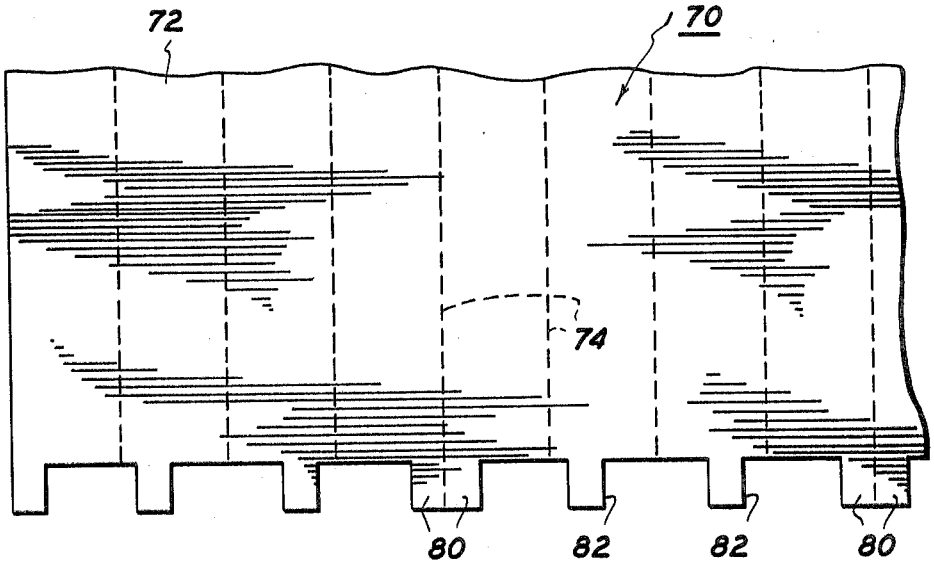
FIG. 6

FIG. 7
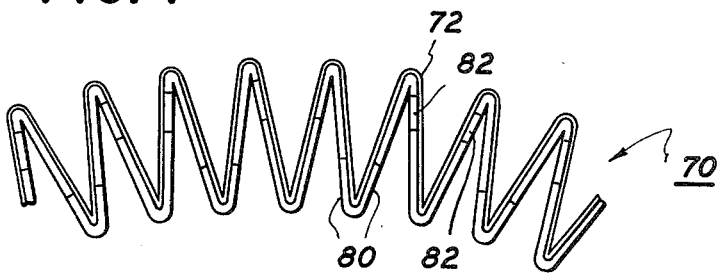
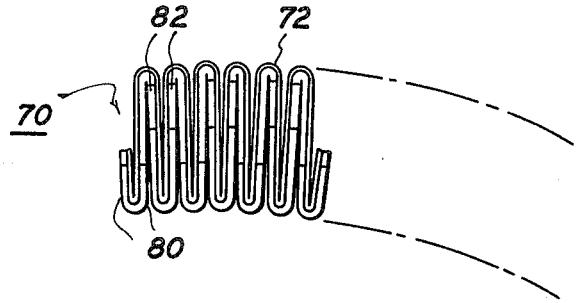
FIG. 8
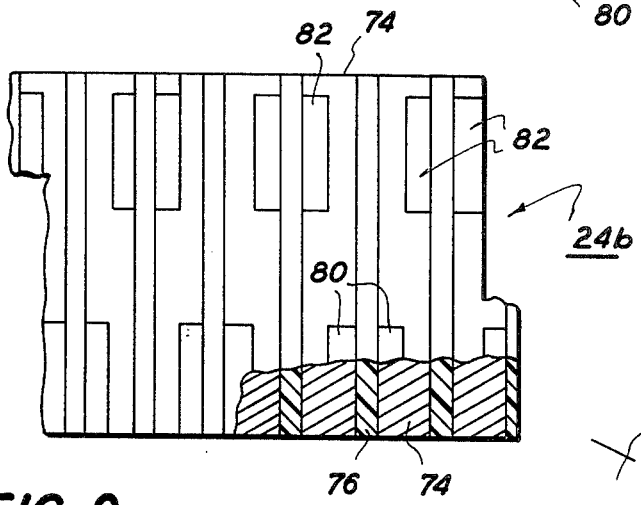
FIG. 9
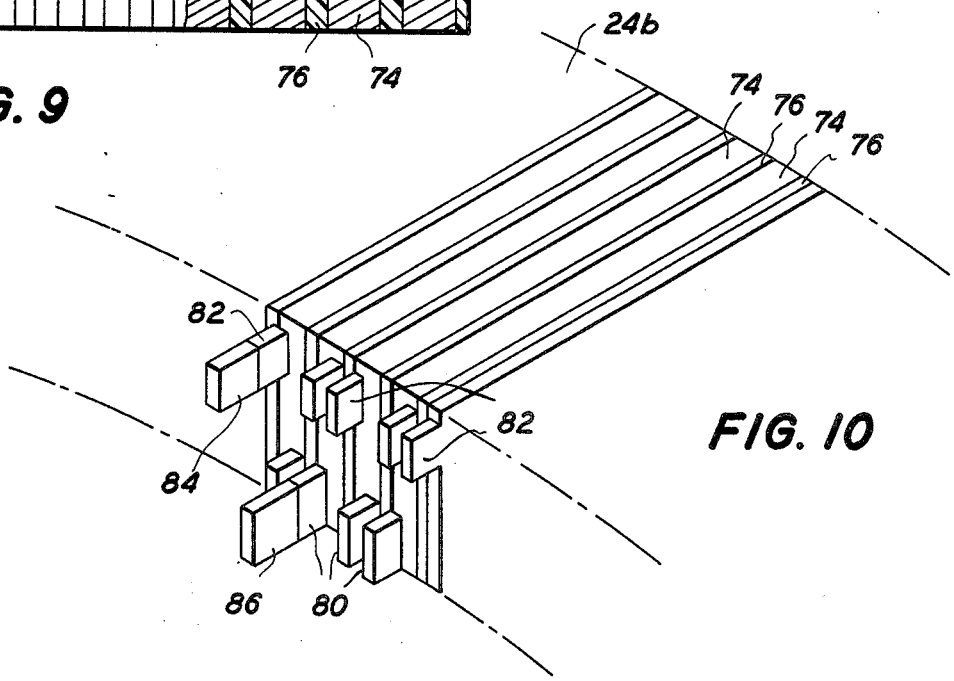
FIG. 10

FIG. 11
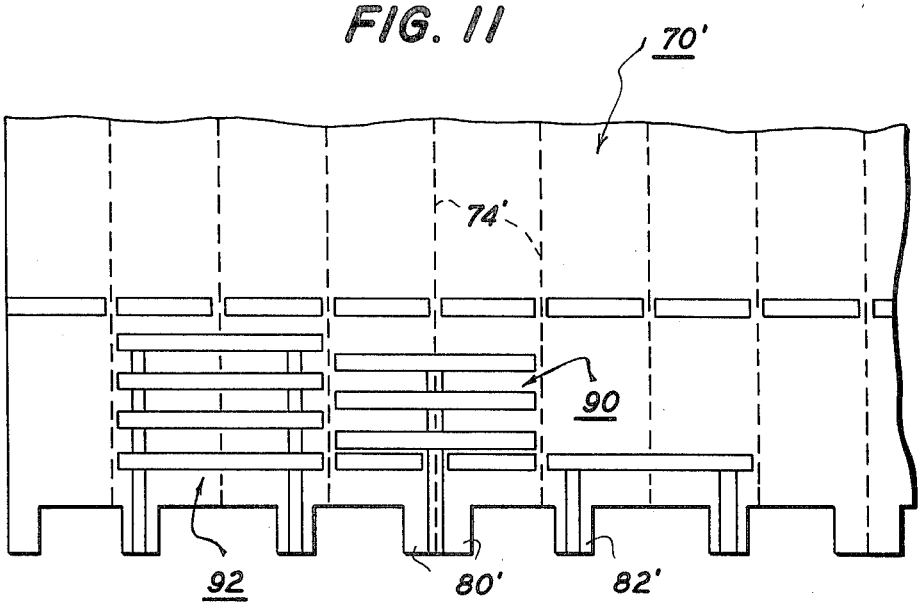
FIG. 12
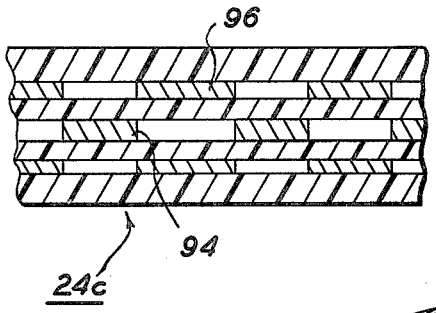
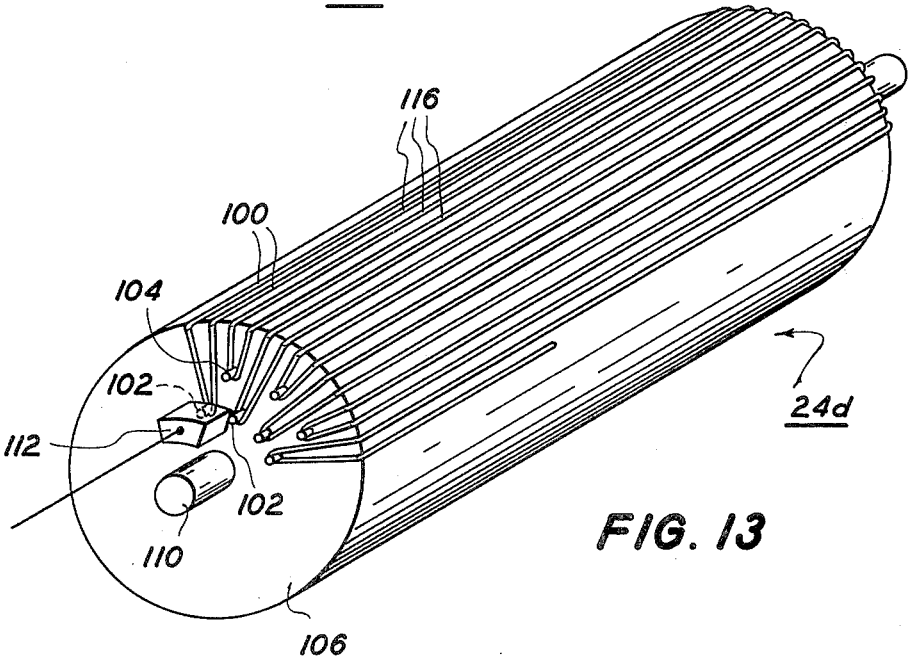
FIG. 13

FIG. 14
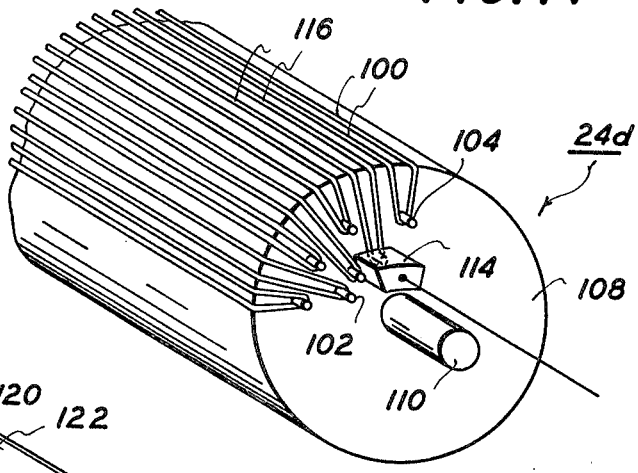
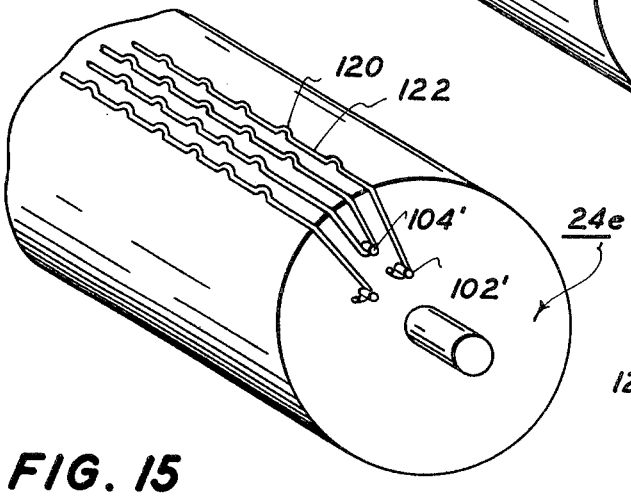
FIG. 15
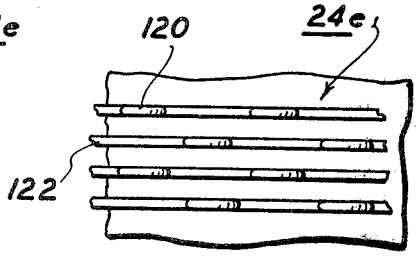
FIG. 16
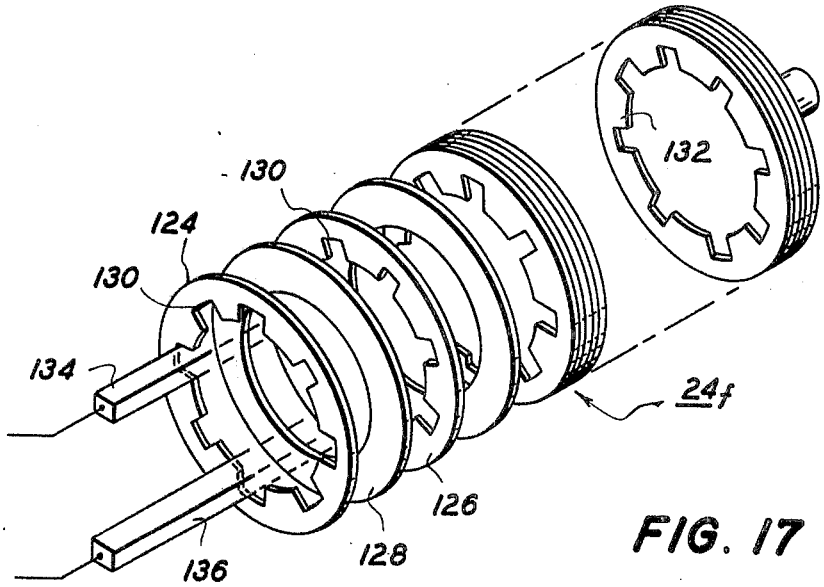
FIG. 17

FIG. 18
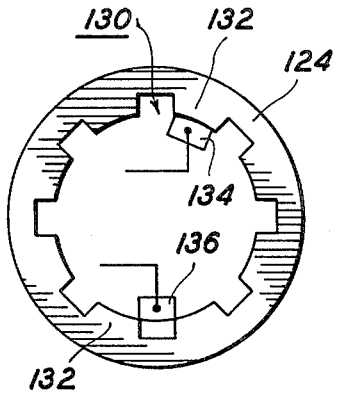
FIG. 19
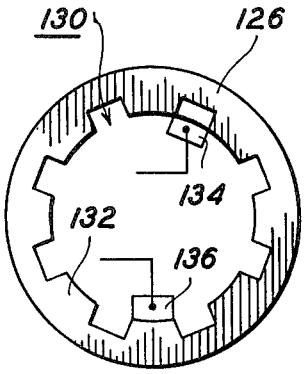
FIG. 20
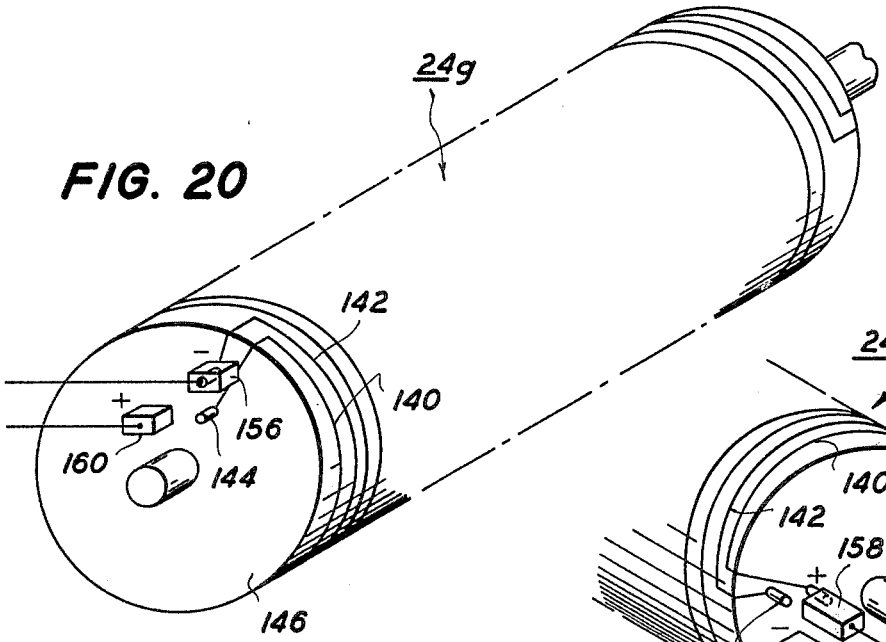
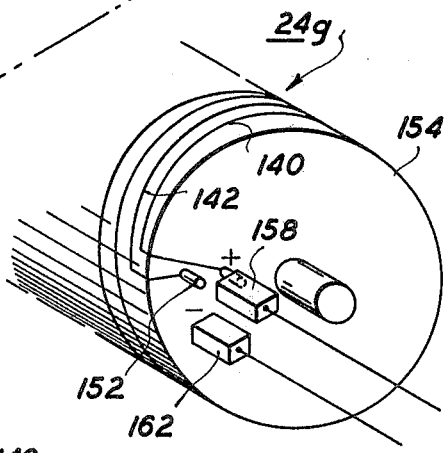
FIG. 21
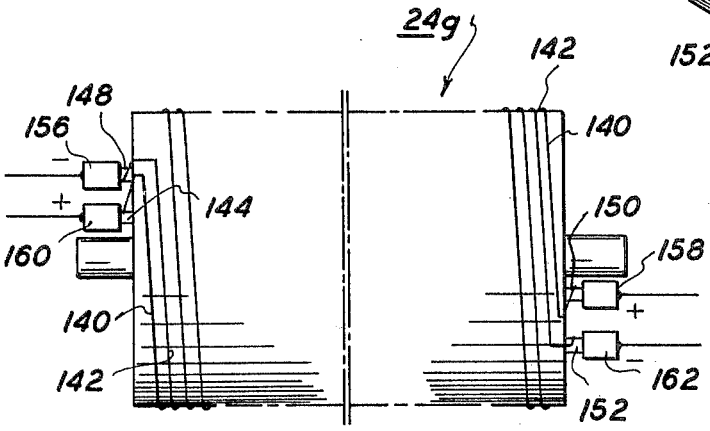
FIG. 22

TONER AGITATION THROUGH MICROFIELD DONOR

This is a division of application Ser. No. 546,589, filed Feb. 3, 1975.

BACKGROUND OF THE INVENTION

1. Field of Invention

This invention relates to xerography and more particularly to an improved method for the development of an electrostatic image in which a toner layer is presented to a latent image for its development.

2. Description of Prior Art

In the xerographic reproduction process, a photoconductive surface is charged and then exposed to a light pattern of the information to be reproduced, thereby forming an electrostatic latent image on the photoconductive surface. Toner particles, which may be finely divided, pigmented, resinous material are presented to the latent image where they are attracted to the photoconductive surface. The toner image can be fixed and made permanent on the photoconductive surface or it can be transferred to another surface where it is fixed.

One known method of developing latent electrostatic images is by a process called transfer development. Transfer development broadly involves bringing a layer of toner to an imaged photoconductor where toner particles are transferred from the layer to the imaged areas. In one transfer development technique, the layer of toner particles is applied to a donor member which is capable of retaining the particles on its surface and then the donor member is brought into close proximinity to the surface of the photoconductor. In the closely spaced position, particles of toner in the toner layer on the donor member are attracted to the photoconductor by the electrostatic charge on the photoconductor so that development takes place. In this technique the toner particles must traverse an air gap to reach the imaged regions of the photoconductor. In two other transfer techinques the toner-laden donor actually contacts the image photoreceptor and no air gap is involved. In one such technique the toner-laden donor is rolled in non-slip relationship into and out of contact with the electrostatic latent image to develop the image in the single rapid step. In another such technique, the toner-laden donor is skidded across the xerographic surface. Skidding the toner by as much as the width of the thinnest line will double the amount of toner available for development of a line which is perpendicular to the skid direction, and the amount of skidding can be increased to achieve greater density or greater area coverage.

It is to be noted, therefore, that the term "transfer development" is generic to development techniques where (1) the toner layer is out of contact with the imaged photoconductor and the toner particles must traverse an air gap to effect development (2) the toner layer is brought into rolling contact with the imaged photoconductor to effect development, and (3) the toner layer is brought into contact with the imaged photoconductor and skidded across the imaged surface to effect development. Transfer development has also come to be known as "touchdown development".

In a typical transfer development system, a cylindrical or endless donor member is rotated so that its surface can be presented to the moving surface of a photoconductive drum bearing an electrostatic latent image thereon. Positioned about the periphery of the donor member are a number of processing stations including a donor loading station, at which toner is retained on the donor member surface; an agglomerate removal station at which toner agglomerates are removed from the toner layer retained on the surface of the donor member; a charging station at which a uniform charge is placed on the particles of the toner retained on the donor surface; a clean-up station at which the toner layer is converted into one of uniform thickness and at which any toner agglomerate not removed by the agglomerate removal station are removed; a development station at which the toner particles are presented to the imaged photoconductor for image development; and a cleaning station at which a neutralizing charge is placed upon the residual toner particles and at which a cleaning member removes residual toner from the peripheral surface of the donor. In this manner, a more or less continuous development process is carried out.

Among the typical donor members employed in the process heretofore was a metal cylinder covered with an insulating enamel upon which was coated a metal electrode in a gravure-screen pattern. A potential of up to 300 volts is impressed between the electrode and cylinder while the cylinder is rotated in a vibrating tray of toner powder. In a mass of toner that appears to be electrically neutral there will be roughly equal amounts of positively and negatively charged particles. Microsized electrostatic fields formed between the electrode and the cylinder cause toner of one polarity to deposit on the electrode and toner of the opposite polarity to deposit on the squares in the electrode. Clumps of excess toner are vacuumed off and the remaining uniformly thick toner layer is corona charged to make it all the same polarity, thus making the donor ready for use in developing an image.

As discussed previously the latent image on a photoconductive surface could be developed by momentarily "touching down" the donor member to the surface. The surface of the photoconductor containing the latent image is charged at a greater potential than the donor surface. Therefore, in charged areas of the surface, toner is attracted from the donor to the surface, in uncharged areas the toner-charge image forces keep the toner particles attracted to the donor, and the surface remains free of toner particles. However, it was found that several such "touchdowns" were needed to produce high density images because of a sparse migration of toner particles from the donor to the photoconductive surface.

Thicker coatings of toner produced by various techniques were explored in attempts to obtain the density desired with one touchdown, but these all seemed subect to the difficulty that where the thick coating of toner touched uncharged areas of, the photoconductor surface, some surface toner particles less strongly attracted to the donor transferred to the photoconductor producing an objectionable background deposit. The obvious solution was to bring the donor only very close to the photoconductor but not into contact with it. Toner will jump across a narrow air gap to charged areas of a xerographic photoconductor surface, but not to uncharged areas. The images thus obtained were greatly improved. This latter process has been termed "spaced touchdown".

It has also been found that the quality of image development can be further enhanced if a toner particle is repelled from the donor surface when the particle comes into the reach of an electrostatic flux line emanating from the image charge on the photoconductor surface. In this case, it can home in on the field line and thus develop the latent image. At the same time, if the proper charge relationship is established between the toner particles and the image and background charges on the photoconductor surface, toner should not move to areas of background on the photoconductor.

For example, U.S. Pat. No. 3,257,223 discloses a powder cloud xerographic development apparatus in which an aerosol of toner particles are formed adjacent to a photoconductor surface by removing the positive potential holding the particles to the donor member to create an unstable condition on the surface of the donor because of the great number of closely adjacent toner particles all having the same charge polarity. Owing to the mutual repulsion of these particles, many of the particles are rapidly forced away or "blown off" from the surface of the donor thus forming an aerosol in the space between the donor and the photoconductor surface being developed. Charged particles in this aerosol are picked up by the electric fields set up by the charge pattern on the photoconductor, thus serving to develop or make visible the charge pattern with these toner particles. The patentee also discloses that repulsion of the toner particles from the surface of the donor may be improved by connecting its conductive base to a potential source opposite in polarity to that utilized during the loading step rather than merely grounding this base. In this manner the repulsive force of a field emanating from donor member is added to the force of mutual repulsion between the toner particles thereby propelling them into the aerosol with greater velocity and uniformity.

The present invention expands and improves on this concept with application to both "in-contact" and "spaced touchdown development" xerographic apparatus.

SUMMARY OF INVENTION

In accordance with this invention, a new type of microfield donor is proposed for use in touchdown development of electrostatic images on a photoconductor surface. The donor member can take a variety of forms, although all of the forms are provided with the common feature of having means to establish a plurality of electrostatic microfields on the donor surface to attract and hold toner particles to the donor so they can be transported to the developing station and means for continuously reversing the polarity fo the established microfields to alternately repel and attract toner particles to the donor surface during their transportation to prevent agglomerations of the particles from forming and to effect nullification of the microfield attracting the particles to the donor adjacent the photoconductor so that it can readily be attracted to the latent image on the photoconductor to form a high density image free of background deposits in uncharged areas of the photoconductive surface.

In one form of the invention, the donor member can take the form of a cylindrical drum constructed from a plurality of lamellar segments which have been fused or otherwise adhered together to form the circumference of the cylindrical drum. The lamellar segments can be punched or etched from sheet material which may be coated on one side with a layer of dielectric material. The segments are then assembled in a cylindrical pattern by fusing the dielectric interfaces to form a rigid cylinder. Once the segments have been fused into a cylindrical tube, further processing such as turning, grinding, lapping, coating, etc. may be used to improve the surface characteristics and radial run out of the drum.

The conductive lamellar segments are formed with commutator tabs and alternate segments are placed in brush contact with ground or a source of positive potential. As the drum rotates each conductive segment will be pulsed from positive potential to ground and then to a positive potential.

Both positive and negative triboelectrically charged toner particles can be picked up by the drum from a vibrating tray. Because of rapid change of potential induced on the donor electrodes or lamellar segments, the toner will be constantly repelled and attracted from and to the electrodes along the circumference of the drum and will be brought into a constant jumping motion along the electrostatic field lines of the donor microfields. When a toner particle comes within the reach of an electrostatic flux line emanating from the image charge on the photoconductive surface, it is repelled by the constantly alternating field induced in the donor electrodes so it can home in on the field line on the photoconductive surface and thus develop the latent image. By constantly having the toner agitated or vibrated, the electrostatic attraction of the toner particle to the donor is nullified at some point when the donor drum is adjacent to the photoconductor surface and by thus nullifying the electrostatic attraction of toner to the donor, the toner may be more readily attracted by the charge induced in the photoconductor surface, without any great increase in potential of the photoconductor surface over the electrostatic charge induced by the microfield of the donor, thus producing a high density image.

Furthermore, by inducing a constant alternating attraction and repulsion of the toner particles to the donor, a more uniform distribution of the toner particles along the surface of the donor is obtained. Otherwise, the toner particles tend to agglomerate and be deposited on the surface of the donor and protrude well above the mean thickness of the remaining toner particles. If some provision is not made for controlling the thickness of the toner layer carried by the donor, thicker regions of the toner layer will be compacted between the donor surface and the surface of the photoconductive layer in the development zone, also producing agglomerates. This build-up of toner in certain areas may result in the deposit of toner on background areas on the photoconductive surface.

Owing to the constant agitation of the toner induced by the alternating field induced in donor about its circumference, high density images are assured on the photoconductive surface. Substantially none of the toner is adhered to the donor, but rather floats adjacent to the donor surface. As a consequence, substantially all of the toner coming into close proximity with the photoconductive surface will be attracted to the electrostatic charge on the latent image on that surface. This dispersal is uniform because of the preclusion of the agglomeration of toner particles in selected areas of the donor.

With the apparatus utilized in the present invention, it is also possible to obtain a deposit of a greater number of toner particles on the donor since the toner particles consist of almost equal quantities of both negative and positively charged particles, rather than biasing the microfield donor so it attracts only negatively charged particles, both positive and negative particles can be attracted and picked up from the toner reservoir.

In another form of the apparatus utilized in the invention the donor element is a conductive cylinder connected to a reference electrial potential. A pair of conductive filaments are wound radially about the circumference of the drum in between each other. Each of the conductive filaments are connected to a source of electrical potential of opposite polarity so that microfields are established between each adjacent pair of filament windings.

The polarity of the conductive filaments can be reversed through commutator contact to agitate the toner particles.

Alternatively, the donor element can be constructed from lamellar conductive rings fused together along dielectric interfaces to form a cylinder. The rings have radial notches cut from their inner circumference and alternate rings are assembled so that their notches are out of phase with respect to each other. The notches provide tabs for commutator contact so that alternate rings can be connected to a source of electrical potential of opposite polarity to establish microfields therebetween. As the cylinder rotates, the polarity of each ring is continuously reversed to agitate the toner particles.

Instead of radial filaments or conductive rings, the donor member can be manufactured using a conductive cylinder having spaced axial wires along the cylinder surface attached to pins on opposite ends of the cylinder. The pins can be provided with brush contact so that adjacent wires are connected to a source of opposite potential to establish a plurality of microfields on the donor surface. The pins on opposite ends of the cylinder in contact with each axial wire are staggered in spacial relation in parallel planes so that as the cylinder rotates to transport toner particles, the polarity of each wire can be reversed for toner agitation.

In certain instances it may be advantageous to form ripples or peaks and valleys in the adjacent wires on the cylindrical surface so that the toner particles will tend to migrate and be held to the cylinder in the wire valleys, rather than extend outwardly from the cylinder surface. By staggering the location of the peaks and valleys on adjacent wires, the microfields can be established with electrostatic flux lines criss-crossing each other between the wires to create denser microfields and cause more uniform dispersal of toner particles on the donor surface adjacent the valleys on the wires.

In a still further modification, a cylindrical donor member is constructed from metalized plastic or metal foil coated with a dielectric on one surface thereof which is folded or pleated in accordian-like fashion. After pleating, the material is compressed to form a cylinder and the dielectric surfaces are fused to rigidify the structure. The edges of the structure can then be bored out and turned down to form separate conductive segments spaced by a dielectric. Pre-cut commutator tabs extend from the end plane of the formed cylinder so that alternate conductive segments can be connected through brush contact with a source of electrical potential of opposite polarity to establish the requisite microfields. The polarity of each segment can be continuously reversed as the cylinder rotates through contact of the end tabs with the stationary brushed to effect toner particle agitation.

With this type of construction, criss-cross fields may also be obtained by silk-screening or otherwise depositing a staggered gridwork of conductive material on a dielectric foil surface and pleating, compressing, fusing and turning the foil into a cylinder as described above. The end portions of the conductive screen, when viewed in plan about the circumference of the cylinder, will provide criss-crossed flux lines about the cylinder.

Further advantages and objects of the invention will become more apparent from the following specification and claims, and from the accompanying drawings, wherein:

BRIEF DESCRIPTION OF THE DRAWINGS

FIG. 1 is a sectional view of xerographic apparatus in accordance with the present invention;

FIG. 2 is a partial isometric view of a section of a microfield donor used in the xerographic apparatus of FIG. 1, formed in accordance with the principles of the present invention;

FIG. 3 is a front view, partly in section, of a portion of the microfield donor section illustrated in FIG. 2;

FIG. 4 is a cross-sectional view taken substantially along the plane indicated by line 4—4 of FIG. 3;

FIG. 5 is a cross-sectional view taken substantially along the plane indicated by line 5—5 of FIG. 2;

FIG. 6 is a partial, top plan view of a precut piece of metal foil used to construct another form of microfield donor in accordance with the present invention;

FIG. 7 is a front view of the foil shown in FIG. 6 after is has been pleated in an intermediate step of constructing a microfield donor;

FIG. 8 is a view similar to FIG. 7 but showing the further step of compressing the pleated foil strip;

FIG. 9 is a front view in elevation, partly in section of the foil strip of FIG. 8 after it has been fused and cut into a donor cylinder.

FIG. 10 is a partial isometric view of a section of the microfield donor cylinder formed in accordance with the steps illustrated in FIGS. 6 to 9;

FIG. 11 is a view similar to FIG. 6, but showing a conductive grid silk-screened onto a dielectric foil which is used to construct still another microfield donor in accordance with the steps illustrated in FIGS. 6 to 9;

FIG. 12 is a partial sectional view through the cylinder formed with the foil illustrated in FIG. 11;

FIG. 13 is a perspective view of still another microfield donor in accordance with the present invention;

FIG. 14 is a partial perspective view of the donor illustrated in FIG. 13 as seen from its opposite end;

FIG. 15 is a view similar to FIG. 14 but using a rippled wire electrode to form criss-crossed microfields on the donor;

FIG. 16 is a partial, enlarged top plan view of the donor element illustrated in FIG. 15;

FIG. 17 is an exploded isometric view of still another microfield donor in accordance with the present invention;

FIG. 18 is a front view in elevation of one of the lamellar ring elements used in the construction of the donor shown in FIG. 17;

FIG. 19 is a front view in elevation of the subsequent conductive lamellar ring used in the donor construction shown in FIG. 17;

FIG. 20 is an isometric view of yet another microfield donor in accordance with the present invention;

FIG. 21 is a partial isometric view of the donor illustrated in FIG. 20 as seen from its opposite end; and FIG. 22 is a front view in elevation of the donor of FIG. 20.

DETAILED DESCRIPTION OF PREFERRED EMBODIMENTS

The present invention relates to a transfer development xerographic apparatus in which toner particles are applied to an electrostatic latent image on a photoconductive surface to develop an image. Although the apparatus is described herein as part of a xerographic copier, it can be utilized in conjunction with any reproduction system wherein a latent image is to be developed by applying toner thereto.

Referring now to the drawings in detail wherein like numerals indicate like elements throughout the several views, and more particularly to FIG. 1, there is shown a xerographic reproduction apparatus utilizing the concept of the present invention. In this apparatus a xerographic plate in the form of a cylindrical drum 10 passes through stations A–E in the direction shown by the arrow. The drum has a suitable photosensitive surface, such as one including selenium overlying a layer of conductive material, on shich a latent electrostatic image can be formed. The various stations about the periphery of the durm which carry out the reproduction process are: charging station A, exposing station B, developing station C, transfer station D, and cleaning station E. Stations A, B, D and E represent conventional means for carrying out their respective functions. Apart from their association with the novel arrangement to be described with respect to station C they form no part of the present invention.

At station A, a suitable charging means 12, e.g., A corotron, places a uniform electrostatic charge on the photoconductive material. As the drum rotates, a light pattern, via a suitable exposing apparatus14, e.g., a projector is exposed onto the charged surface of drum 10. The latent image thereby formed on the surface of the drum is developed or made visable by the application of a finely divided pitmented, resinous powder called toner, at developing station C, which is described in greater detail below. After the drum is developed at station C, it passes through transfer station D comprising a copy sheet 16, corona charging device 18 and fusing device 20. Following transfer and fixing of the developed image to the copy sheet, the drum rotates through cleaning station E, comprising cleaning device 22, e.g., a rotating brush, at which residual toner is removed.

At developing station C, the apparatus includes a donor member 24 (more particularly described below) rotatably mounted adjacent a toner reservoir 26, containing a supply of toner particles 28. The donor member 24 is positioned so that a portion of its periphery comes into contact with toner particles 28. The donor member is also located so as to provide a small gap between the surface of drum 10 and the outer surface of a toner layer carried by donor roll 24. As toner particles are presented to the electrostatic imaged regions of drum 10, the particles traverse this small gap thereby developing the latent image.

Located between toner reservoir 26 and the development zone is a charging means 30, such as a corona charging device, which is adapted to place a uniform charge on the toner particles of a polarity opposite to the polarity of the latent image on the photoconductive drum 10.

The construction of microfield donor 24, which carries the toner particles 28 to developing station C, comprises the subject of the instant invention. One form of a particular donor structure which is suitable to carry out the concepts of the invention is illustrated in FIGS. 2 to 5, inclusive.

As illustrated in FIG. 2, microfield donor 24a is constructed from a plurality of lamellae 32. Lamellae 32 are punched or etched from conductive sheet material and sandwiched between layers of dielectric material 34 with preselected electrical properties. Lamellae 32 may be coated on one side with a similar dielectric material and the lamellar segments may be fixed together by fusion of the dielectric interfaces of dielectric segments 34 and the dielectric coating on conductive lamellae 32 in a cylindrical pattern as shown clearly in FIG. 2. The rigid cylinder 24a so formed may be further processed such as by turning, grinding, lapping, etc.

The conductive lamellar segments 32 are formed with a radial extension 36 adjacent their front end. Radial extension 36 is provided with a pair of commutator tabs 38, 40 forming a conductive edge 46 and a pair of commutator tabs 42,44 forming a conductive edge 48.

Each lamellar segment 32 of microfield donor **24*a* is oriented so that an electrical potential may be established between any two adjacent segments by alternately electrifying or grounding any one of the two adjacent segments through their commutator tab pairs 38, 40 and 42, 44 (forming edge 48) which are placed in sliding contact with stationary brushes 50 and 52, respectively, as the donor 24*a* rotates about the axis of shaft 54. All of the brushes 50 are connected to ground 56 through a slip ring 58 on shaft 54, while all of the brushes 52 are connected to a source of positive potential 58 through a slip ring 60 on shaft 54**.

As microfield donor **24*a* rotates in the direction of the arrow shown in FIG. 2, each lamellar segment 32 on the microfield donor 24*a* is alternately and rapidly pulsed between ground and a positive potential and then from a positive potential back to ground through sliding contact with brushes 50 and 52. Thus, charged toner 28, which was initially picked up from vibrating reservoir 26 and subjected to a charge of the same polarity by corona charging device 30, is alternately repelled and attracted between adjacent lamellar segments 32, which act as electrodes. In this manner the toner particles 28 are brought into a constant jumping motion along the electrostatic field lines between the lamellar segments or electrodes 32 at the donor 24*a*** transports them to the development station C.

When a toner particle 28 is repelled from the surface of the microfield donor **24*a* and comes within the reach of an electrostatic flux line emanating from the image charge on the photoconductive surface of drum 10 adjacent station C it can home in on the field line more readily and thus develop the latent image. At the same time, toner should not move to the areas of background on the photoconductive drum 10**.

Basically the toner is agitated or vibrated on the microfield donor **24*a* so that the toner particles may be attracted to the image area on the photoconductor more readily by nullifying the electrostatic attraction of the toner particles 28 to the donor cylinder 24*a* . By nullifying the electrostatic attraction at station C the charge on a latent image will be more readily able to pull the toner particles to the image. Further, by enabling the toner to be brought into a constant jumping motion along the donor surface substantially all toner on the surface is attracted to the photoconductive surface of drum 10** enabling a high density image to be developed.

Because of the conditions difficult to control, some of the toner particles 28 would normally tend to agglomerate on a conventional donor surface. These agglomerations would be deposited on the surface of the photoconductive drum 10 causing background development. In addition, if some provision is not made for controlling the thickness of the toner layer carried by the donor, thicker regions of the toner layer will be compacted between the donor and the surface of the photoconductor in the development zone adjacent station C also causing background development.

With the microfield donor 24*a* of the present invention, however, such agglomeration is substantially eliminated. By constantly agitating the toner particles 28 by reversing the established microfields, buildups of toner particles on the donor is substantially eliminated as the particles tend to be uniformly dispersed about the cylindrical surface.

Also the quantity of toner particles removed from reservoir 28 can be increased. Since the reservoir 26 will contain toner particles which are charged positively and negatively in substantially equal amounts, by constantly reversing the microfields on the donor surface, both types of particles will be inititally attracted to the donor surface.

It should be understood that alternate lamellar segments or electrodes 32 in lieu of being connected alternately to ground and positive potentials, could be connected to positive and negative potentials, respectively. In this instance the proximity of donor 24*a* to the toner reservoir 26 or photoconductive drum 10 establishes the necessary ground reference potential. This configuration will not only result in the attraction of a greater amount of electrostatically charged toner particles from reservoir 26, but will aid in impelling the particles across the gap at station C by increasing the repelling force on e.g. negative charged particles, rather than merely nullifying the electrostatic attraction to the microfield donor 24*a*.

Other types of drums or microfield donors could function with the same alternating or pulse field concept.

For example, a cylindrical donor member 24*b* as shown in FIG. 10, can be formed as illustrated in FIGS. 6 to 9 from metallized plastic or metal foil 70 coated with a dielectric 72 on one surface thereof. The foil 70 is folded or pleated along lines 74 in accordian-like fashion, as shown in FIG. 7. After pleating, the material is compressed as shown in FIG. 8 into a cylindrical configuration and the adjacent dielectric surface 72 are fused together to rigidify the structure. The edges of the structure can then be cut to form separate conductive segments 74 spaced by a dielectric 76 as illustrated in FIGS. 9 and 10.

Pre-cut commutator tabs 80 and 82 extend from the end plane of the donor cylinder 24*b*. When donor cylinder 24*b* is assembled as shown in FIGS. 9 and 10, tabs 82 form a top row and tabs 80 form a bottom row. Each conductive segment 74 has one of each of tabs 80, 82. Stationary brushed 84 and 86 are positioned to contact tabs 82 and 80, respectively, on adjacent segments 74 spaced by dielectric 76, so that alternate conductive segments 74 can be connected to a source of electrical potential of opposite polarity to establish the requisite microfields between alternate conductive segments 74. The polarity of each segment 74 can be continously reversed as the cylinder rotates through alternate contact of the end tabs 80, 82 on each segment 74 with the stationary brushes to effect toner particle agitation.

With this type of donor construction, criss-cross fields may also be obtained by silk-screening or otherwise depositing staggered gridworks 90 and 92 of conductive material on a dielectric foild surface 70' as shown in FIG. 11 and pleating, compressing, fusing and turning the foil into a cylinder 24*c* as described above. The end portions of the conductive screen, when viewed in plan about the circumference of the cylinder as shown in FIG. 12, will provide criss-crossed flux lines beteween screen grid elements 94 and 96 about the cylinder 24*c*. The commutator tab arrangement is identical to that on cylinder 24*b* as the conductive grids 90, 92 are extended onto the dielectric tabs 80' and 82'.

In another form of the invention, the donor member can be manufactured using a conductive cylinder 24*d* as shown in FIGS. 13 and 14 having an axial wire 100, with two spaced strands of its conductive surface exposed and extending along the cylinder surface. Wire 100 is looped around a conductive pin 102 and 104 extending outwardly from opposite ends 106 and 108, respectively, of the cylinder 24*d*.

An adjacent axial wire 116 is connected to a pin 102 on cylinder end 108 and a pin 104 on cylinder end 106. Accordingly, as cylinder 24*d* rotates, pin 102 on cylinder end 106 can contact a stationary brush 112 which will connect both strands of axial wire 100 to a source of electric potential of one polarity. At the same time, the strands of adjacent axial wire 116 are connected to a source of electrical potential of opposite polarity through contact of lower pin 102 on cylinder end 108 with a stationary brush 114. Adjacent strands of wires 100 and 116 are therefore connected to a source of opposite potential to establish a microfield on the donor surface between these strands. A series of brushes 112 and 114 arranged at opposite ends of cylinder 24*d* in contact with pins 102 assure that adjacent strands of the looped axial wires are of different polarity as the cylinder 24*d* rotates to transport toner particles and the polarity of each wire strand can be reversed continuously for toner agitation if each of the series of brushes 112 and 114 are connected alternatively to sources of electrical potential having opposite polarity.

In certain instances it may be advantageous to form ripples or peaks 120 and valleys 122 in the adjacent axial strands on a cylindrical surface 24*e* so that the toner particles will tend to migrate and be held to the cylinder in the wire valleys 122, rather than extend outwardly from the cylinder surface. By staggering the location of the peaks 120 and valleys 122 on adjacent strands of the axial wires, the microfields can be established with electrostatic flux lines criss-crossing each other between the strands to create denser microfields and cause more uniform dispersal of toner particles on the donor surface 24*e* adjacent the valleys 122.

Alternatively, a donor element 24*f* can be constructed from lamellar conductive rings 124, 126 coated with a dielectric on one surface and fused together through the intermediary of a dielectric ring 128 to form the cylinder 24*f* as shown in FIG. 17. The rings have radial notches 130 cut from their inner circumference. Alternate rings 124, 126 are assembled so that their notches 130 are out of phase with respect to each other, as shown in FIG. 18 and 19. The notches 130 provide tabs 132 for contact with stationary brushes 134 and 136 connected to sources of electrical potential of opposite polarity. Brushes 134 and 136 extend the length of cylinder **24*f*, so that alternate rings can be connected to a source of electrical potential of opposite polarity to establish microfields therebetween. As the cylinder 24*f*** rotates, the polarity of each alternate ring is continuously reversed to agitate the toner particles.

Instead of conductive rings, in another form of the invention the donor element can be a conductive cylinder **24*g* as shown in FIGS. 20 to 22 which is subjected to a reference electrical potential. A pair of conductive filaments 140, 142 are wound radially about the circumference of the drum in between each other. Each of the conductive filaments 140, 142** are connected to a source of electrical potential of opposite polarity through commutator contact so that microfields are established between each adjacent pair of filament windings.

As shown in FIG. 20, one end of exposed filament 140 is connected to a pin 144 extending outwardly from the plane of cylinder end 146. One end of exposed filament 142 is connected to a pin 148 which also extends outwardly from the plane of cylinder end 146. The opposite ends of filaments 140 and 142 are connected to pins 150 and 152, respectively, extending outwardly from the plane of cylinder end 154.

Pin 148 connected to filament 142 is initially in contact with a stationary brush 156 and pin 150 connected to filament 140 is initially in contact with a stationary brush 158. Brushes 156 and 158 are connected to sources of electric potential of opposite polarity to establish microfields between the adjacent windings of filaments 140 and 142. As cylinder **24*g* rotates, pin 144 connected to filament 140 will contact stationary brush 160, while pin 152 connected to filament 142 will simultaneously contact stationary brush 162, reversing the polarity of the filaments 140 and 142 to cause toner agitation. When brushes 160 and 162 are operative, brushes 156 and 158 are inoperative and conversely, when brushes 156 and 158 are operative, brushes 160 and 162 are inoperative. Brushes 160 and 158 are connected to sources of electrical potential of the same polarity, while brushes 156 and 162** are similarly situated. A series of stationary brushes as disclosed are used in order to continuously reverse or pulse the established microfields.

What is claimed is:

1. The method of transporting triboelectrically charged toner particles to a latent electrostatic image on the surface of a xerographic photoconductor for development of said image comprising the steps of forming an electrically conductive support member by providing a plurality of electrically conductive elements, separating said electrically conductive elements by disposing dielectric material between each of said conductive elements, connecting adjacent ones of said conductive elements to a source of different electrical potential so as to establish an electrical potential difference between said adjacent elements attracting toner particles to said conductive elements, and continuously reversing the connection of adjacent ones of said conductive elements to said sources of different electrical potential while moving said electrically conductive elements towards the xerographic photoconductor.

2. The method of claim 1 including the step of:

alternately biasing adjacent ones of said conductive elements between a reference potential and a positive potential.

3. The method of claim 1 including the step of:

alternately biasing adjacent ones of said conductive elements between a negative potential and a positive potential.

4. A Method of transporting triboelectrically charged toner particles on a conductive support member to a latent electrostatic image on the surface of a xerographic photoconductor for development of said image, said conductive support member including a plurality of electrically conductive elements with adjacent ones of said electrically conductive elements being separated by a dielectric material located between each of said elements, adjacent ones of said electrically conductive elements being connected to a source of different electrical potential so as to establish an electrical potential difference between said adjacent conductive elements attracting toner particles to said conductive elements, comprising the step of:

continuously reversing the connection of adjacent ones of said conductive elements to said sources of different electrical potential while moving said electrically conductive elements toward the xerographic photoconductor.

* * * * *